US005347670A

United States Patent [19]

Duguette et al.

[11] Patent Number: 5,347,670

[45] Date of Patent: Sep. 20, 1994

[54] LOCKING PLIER WITH WIRE CUTTER

[75] Inventors: Paul J. Duguette, Dudley; Neil A. Gatto, Worcester; Ronald J. Boliver, Auburn; Daniel J. Laforest, Bellingham, all of Mass.

[73] Assignee: The Stanley Works, New Britain, Conn.

[21] Appl. No.: 85,635

[22] Filed: Jun. 30, 1993

[51] Int. Cl.[5] ..... B25F 1/00

[52] U.S. Cl. ..... 7/107; 7/134

[58] Field of Search ..... 7/107, 130–134; 81/367, 418

[56] References Cited

U.S. PATENT DOCUMENTS 3,181,181 5/1965 Buckley et al. ..... 7/131

4,104,752 8/1978 Amrein et al. ..... 7/107

*Primary Examiner*—James G. Smith

*Attorney, Agent, or Firm*—Samuels, Gauthier & Stevens

[57] ABSTRACT

A locking pliers and wire cutter combination tool having a handle with mutually spaced parallel flanges with edges extending across a cutting zone. A wire cutting notch is formed in the edge of one flange and the other is provided with a ramp aligned with the base of the notch. A fixed jaw is attached between the flanges and a movable jaw is pivotally connected opposite the fixed jaw. The movable jaw includes a cutting blade arranged to traverse the cutting zone and a spring urges the movable jaw into an open position. An operating lever and connecting link are connected in such a manner as to actuate the movable jaw. The single notch reliably retains the wire within the cutting zone while insuring that shearing occurs at only one location.

6 Claims, 2 Drawing Sheets

LOCKING PLIER WITH WIRE CUTTER

BACKGROUND OF THE INVENTION

1. Field of the Invention

This invention relates generally to hand tools, and is concerned in particular with an improved locking plier and wire cutter combination.

2. Description of the Prior Art

Locking pliers with wire cutting capabilities are known in a variety of designs. In one form, as illustrated for example in U.S. Pat. No. 3,181,181 (Buckley et al), the wire is held in aligned notches in the spaced flanges of the handle supporting the fixed jaw, and a cutting blade on the movable jaw passes between the handle flanges and across the notches to effect shearing of the wire. Shearing often occurs at both notches, in effect doubling the force required. At other times, shearing occurs at only one notch, with a portion of the wire being bent at and jammed into the other notch. These problems are avoided in other designs of the type shown for example in U.S. Pat. Nos. 2,590,031 (Peterson); 4,541,312 (Peterson); and 4,542,669 (Roux) where the coacting cutting surfaces do not include wire retention notches. The absence of notches, however, leads to other problems, the most troublesome of which is the tendency of the wire to roll or slip out of the cutting zone as the blades are brought together.

The conventional tools also initiate shearing with the operating lever widely spaced from the handle, thereby making it difficult to apply sufficient force. Once shearing occurs, the operating lever snaps closed, often pinching the user's fingers against the handle.

A general objective of the present invention is the provision of an improved tool having a cutting mechanism which functions reliably without jamming, with the geometry of the actuating components arranged to facilitate the application of appropriate shearing forces while minimizing any exposure of the user to pinching once shearing occurs.

SUMMARY OF THE INVENTION

In accordance with the invention, a locking plier and wire cutter is provided with a handle having mutually spaced parallel flanges with edges extending across a cutting zone. A wire retaining notch is provided in the edge of one of the flanges, and the edge of the other flange is preferably configured to define a ramp aligned with the base of the retaining notch. A fixed jaw is secured to the handle between its flanges at one end of the cutting zone, and a movable jaw is connected between the handle flanges for pivotal movement about a first axis relative to the fixed jaw. The movable jaw includes a cutting blade arranged to traverse the cutting zone, and a spring urges the movable jaw into an open position at the opposite end of the cutting zone. An operating lever is pivotally connected to the movable jaw at a second axis spaced from and parallel to the first axis. A connecting link is pivotally connected at one end to the operating lever at a third axis parallel to the first and second axes. The opposite end of the connecting link engages an adjustable screw carried on the handle. As the operating lever is closed against the biasing action of the spring, the cutting blade on the movable jaw traverses the cutting zone to effect shearing of a wire having one segment captured in the single notch and having another segment supported on and free to move angularly across the adjacent ramp. The single notch reliably retains the wire within the cutting zone while insuring that shearing occurs at only one location. Since the other supported segment of the wire is free to slide angularly across the adjacent ramp, jamming is avoided.

Preferably, the handle, movable jaw, operating lever and connecting link are arranged such that reference lines connecting the second axis with the first and third axes enclose an angle ranging between 89°-112° when the cutting edge initially engages the wire, and at the point where the cutting edges has traversed across the notch to effect shearing of the wire, the same angle has been reduced to between 74°-93°.

Preferably, when the jaws are in mutual contact, the cutting blade lies on a reference line spaced from a parallel reference line tangent to the closest segment of the cutting notch by a distance of no more than 0.05-0.15 inches.

These angular and spatial relationships facilitate the application of appropriate shearing forces while at the same time minimizing the snap action and exposure to pinching which occurs as the wire is sheared.

Other objects and advantages of the present invention will become more apparent as the description proceeds with reference to the accompanying drawings, wherein:

DETAILED DESCRIPTION OF PREFERRED EMBODIMENT

Figure 1:
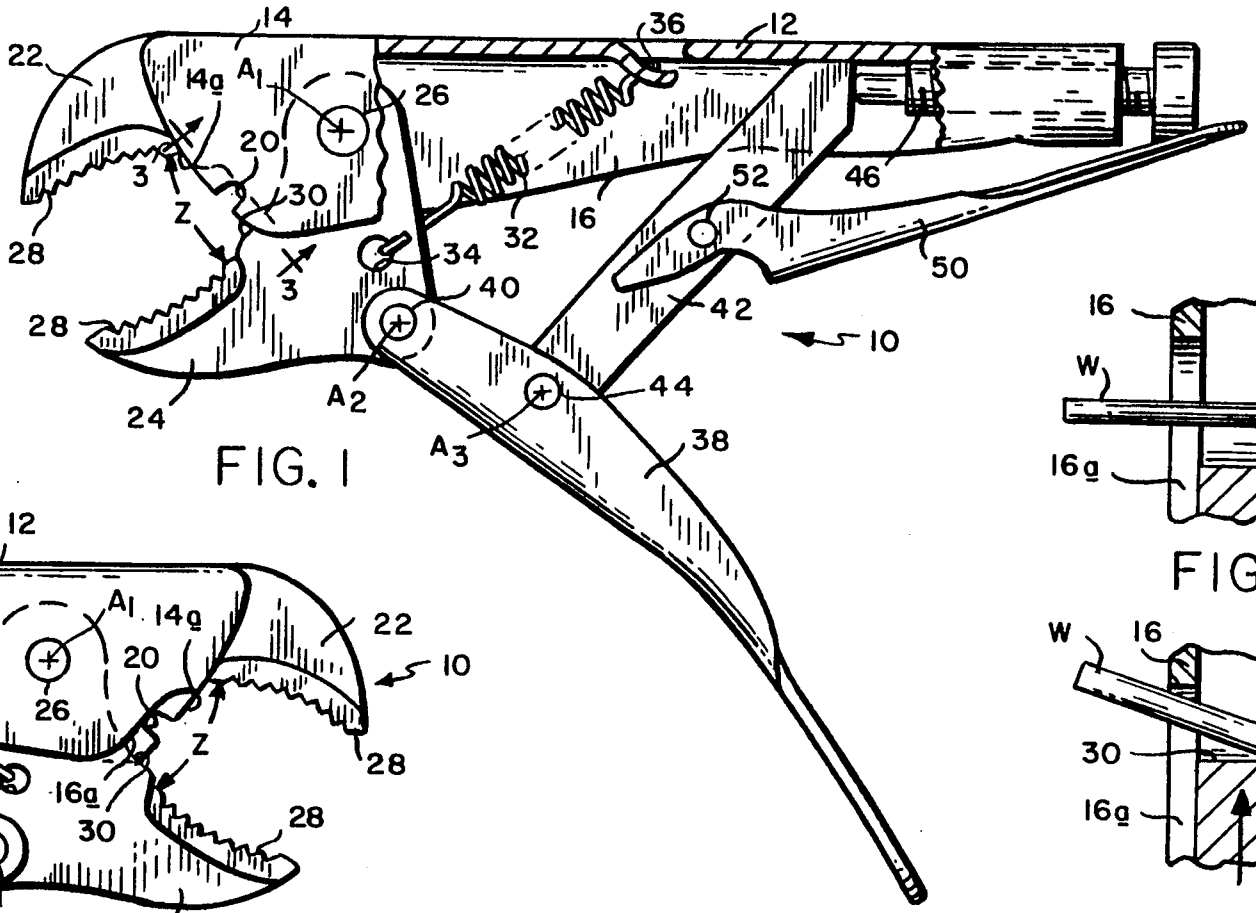
FIG. 1 is a view in side elevation with portions broken away, of a locking plier and wire cutter in accordance with the present invention, shown in the open condition.
Figure 2:
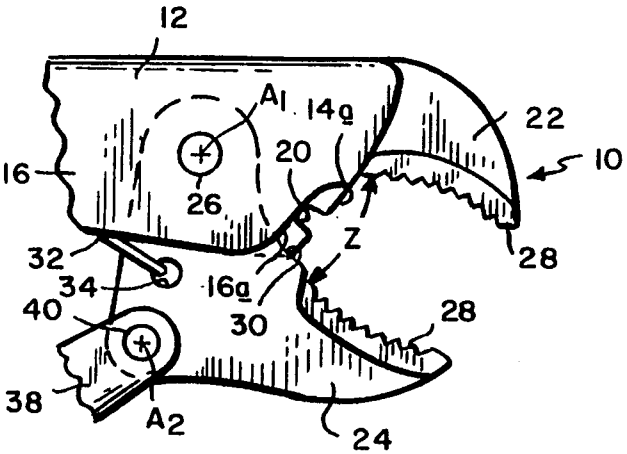
FIG. 2 is a partial view in side elevation of the opposite side of the plier and wire cutter.

With reference initially to FIGS. 1-3, a locking plier and wire cutter 10 in accordance with the present invention is shown comprising a handle 12 having a generally U-shaped cross section with parallel side flanges 14, 16 defining a space 18 therebetween. The forward edges **16*a*, 16*a*** of the side flanges extend across a cutting zone "Z".

A notch 20 is located in edge **14*a* within the cutting zone. The adjacent edge 16*a* is appropriately shaped to define a ramp generally parallel to edge 14*a*, but aligned with the bottom of notch 20**.

A fixed jaw 22 is secured to the handle 12 between the side flanges 14, 16 at one end of the cutting zone Z. A movable jaw 24 is connected to the handle between the side flanges for pivotal movement about a first axis $A_1$ defined by a cross pin 26. The jaws 22, 24 have serrated gripping surfaces 28, and the movable jaw 24 is additionally provided with a cutting blade 30 arranged to traverse the cutting zone Z.

A spring 32 is connected at one end as at 34 to the movable jaw 24 and at the opposite end as at 36 to the handle 12. Spring 32 serves to yieldably bias the movable jaw into its fully open position.

An operating lever 38 is connected to the movable jaw for pivotal movement about a second axis $A_2$ defined by cross pin 40. A connecting link 42 extends between the operating lever and the handle. One end of link 42 is connected to the operating lever for pivotal movement about a third axis $A_3$ defined by across pin 44, and the opposite end of the link bears against the end of an adjusting screw 46 threaded into the rear end of the handle 12. A release lever 50 is pivotally connected as at 52 to the connecting link 42.

The operating lever 38 and connecting link 42 coact in a well known manner with the handle 12 and its adjusting screw 46 to provide a toggle action which serves to lock the movable jaw 24 at selected locations relative to tile fixed jaw 22. The release lever 50 provides a convenient means for disengaging the toggle locking action. This arrangement of components and its manner of usage is well known to those skilled in the art, and thus need not be further described at this time.

Figure 3A:
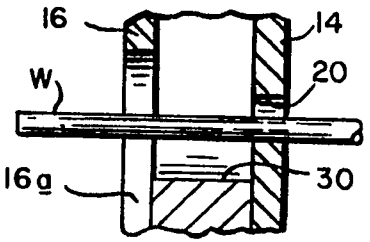
FIG. 3A and 3B are sectional views on an enlarged scale taken along line 3—3 of FIG. 2.

At the commencement of a wire cutting operation, as depicted schematically in FIG. 3A, a wire "W" is initially placed in the cutting zone Z, one segment of the wire being seated in the notch 20, and an adjacent segment of the wire being supported on the ramp defined by edge 16*a*. Thereafter, the operating lever 38 is depressed towards the handle 12, causing the movable jaw 24 to pivot towards fixed jaw 22 about axis $A_1$. This in turn results in movement of the cutting blade 30 across the cutting zone Z into contact with the wire W. The wire segment supported on the ramp edge 16*a* twists angularly about point "P" as shearing occurs at notch 20. The freedom of the wire to slide along ramp edge 16*a* avoids double shearing, and thus significantly diminishes the force required to depress operating lever 38. This in turn lessens the resulting snap action as the cut is completed, thereby reducing the risk of injury to the user's fingers.

Figure 3B:
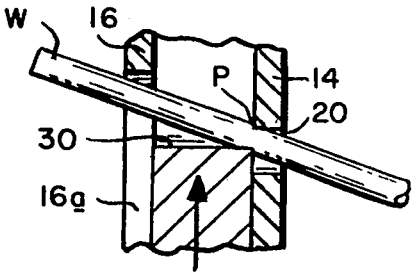
Figure 4:
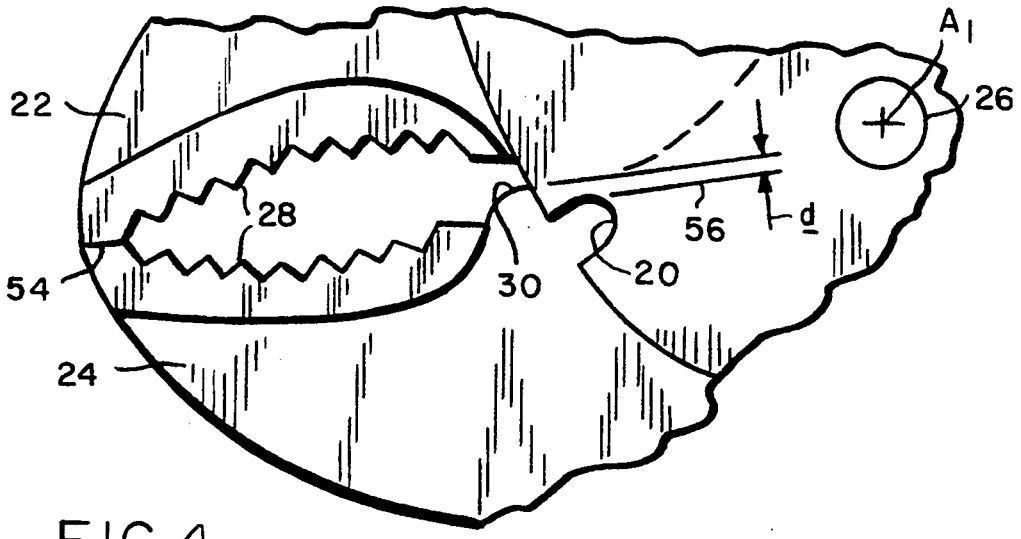
FIG. 4 is a partial side elevational view showing the jaws fully closed.
Figure 5:
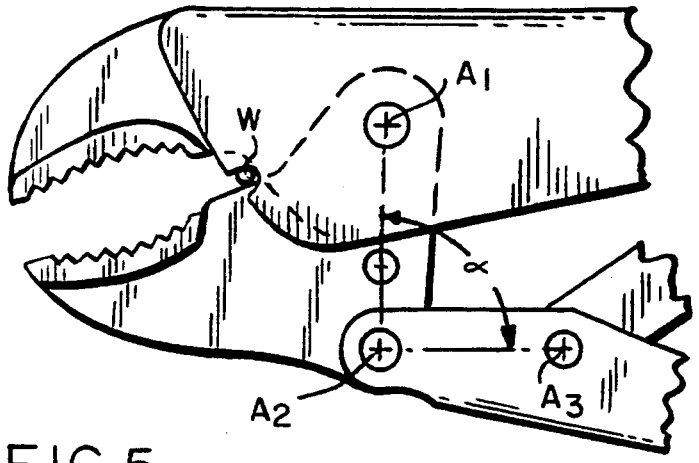
FIG. 5 is a view similar to FIG. 4 showing the jaws positioned at the commencement of a wire cutting operation.

Another aspect of the present invention lies in minimizing the angular spacing between the operating lever 38 and the handle 12 at both the commencement and conclusion of a wire cutting operation. In order to achieve this objective, and as can best be seen by reference to FIG. 4, the tool is designed such that when the jaws 22, 24 are in mutual contact as at 54, the cutting edge 30 is spaced from the closest parallel reference line 56 tangent to the notch 20 by a distance "d" of between about 0.05–0.15 inches. This spatial relationship results in certain beneficial angular relationships between the operating lever 38 and the handle 12 during critical stages of wire cutting operations. For example, and with reference to FIG. 5, at the commencement of a cutting operation (as also shown in FIG. 3B), the angle $\alpha$ defined by reference lines connecting axis $A_2$ to axes $A_1$ and $A_3$ ranges between 89°–112°, and is preferably between about 89°–95°. This angular relationship makes it possible for users having smaller hands to comfortably exert the forces required to effect wire cutting.

Figure 6:
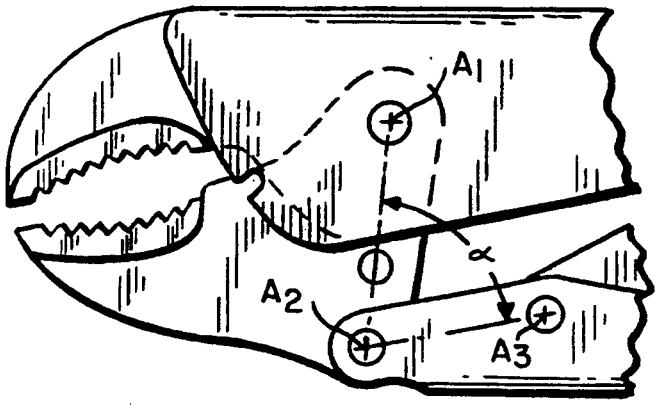
FIG. 6 is another view similar to FIGS. 4 and 5 showing the jaws positioned at the end of a wire cutting operation.

At the conclusion of a cutting operation, as depicted in FIG. 6, when the cutting edge has swept across the notch 20, angle $\alpha$ ranges between about 74°–93°. This minimizes the angular distance between lever 38 and handle 12 and thus reduces the chance that a user's fingers will be pinched as the lever snaps closed.

We claim:

1. A locking plier and wire cutter comprising:

a handle having parallel flanges with edges extending across a cutting zone, said flanges defining a space therebetween;

a notch at said cutting zone in the edge of one of said flanges, the adjacent edge of the other of said flanges defining a ramp aligned with the bottom of said notch;

a fixed jaw secured to said handle between said flanges at one end of said cutting zone;

a movable jaw connected to said handle between said flanges for pivotal movement about a first axis, said movable jaw having a cutting edge arranged to traverse said cutting zone;

spring means for yieldably biasing said movable jaw into an open position at the opposite end of said cutting zone; and actuating means pivotally connected to said movable jaw at a second axis parallel to said first axis, said actuating means being coactively associated with said handle for urging said movable jaw from said open position towards said fixed jaw, thereby causing said cutting edge to shear a wire having mutually spaced segments arranged respectively in said notch and on said ramp.

2. A locking plier and wire cutter, comprising a handle having parallel flanges with top edges extending across a cutting zone, said flanges defining a space therebetween;

a notch in the top edge of at least one of said flanges;

a fixed jaw secured to said handle between said flanges at one end of said cutting zone;

a movable jaw connected to said handle between said flanges for pivotal movement about a first axis between a closed position contacting said fixed jaw and an open position spaced therefrom;

said movable jaw having a cutting edge arranged to traverse said cutting zone;

spring means for yieldably biasing said movable jaw into said open position; and actuating means for urging said movable jaw from said open position toward said fixed jaw and across said cutting zone to shear a wire seated in said notch, said actuating means including an operating lever pivotally connected to said movable jaw at a second axis parallel to said first axis, and a connecting link pivotally connected at one end to said operating lever at a third axis parallel to said first and second axes, and in engagement at its opposite end with an adjustable element carried on said handle;

wherein reference lines connecting said second axis to said first and third axes enclose and angle of between 89° and 112° when said cutting edge initially engages said wire.

3. The locking plier and wire cutter of claim 1 wherein said actuating means includes an operating lever pivotally connected to said movable jaw at said second axis, and a connecting link pivotally connected at one end to said operating lever at a third axis parallel to said first and second axis, and in engagement at its opposite end with a screw carried on said handle, said screw being adjustable to accommodate a self locking toggle relationship between said handle, lever and link at various settings of said movable jaw in relation to said fixed jaw.

4. The locking plier and wire cutter of claim 3 wherein reference lines connecting said second axis to said first and third axes enclose an angle of between 89° and 112° when said cutting edge initially engages said wire.

5. The locking plier and wire cutter of any one of claims 2–4 wherein reference lines connecting said second axis to said first and third axes enclose an angle of between 74° and 93° when said cutting edge has traversed across said notch to effect shearing of said wire.

6. The locking plier and wire cutter of any one of claims 2–4 wherein when said jaws are in mutual contact, said cutting edge is spaced from the closest parallel reference line tangent to said notch by a distance of between 0.05 and 0.15 inches.

* * * * *

UNITED STATES PATENT AND TRADEMARK OFFICE

CERTIFICATE OF CORRECTION

PATENT NO. : 5,347,670
DATED : September 20, 1994
INVENTOR(S) : Paul J. Duquette et al It is certified that error appears in the above-indentified patent and that said Letters Patent is hereby corrected as shown below:

Title page, [19] "Duguette et al." and insert therefor -- Duquette et al. --.

Title page cancel " [75] Inventors: Paul J. Duguette," and insert therefor -- [75] Inventors: Paul J. Duquette, --.

Signed and Sealed this

Fifteenth Day of November, 1994

*Attest:*

Bruce Lehman

BRUCE LEHMAN

*Attesting Officer*

*Commissioner of Patents and Trademarks*